US006450613B1

(12) United States Patent
Rietbergen

(10) Patent No.: US 6,450,613 B1
(45) Date of Patent: Sep. 17, 2002

(54) PRINT HEAD FOR AN INKJET PRINTER

(75) Inventor: Mark Rietbergen, Roermond (NL)

(73) Assignee: Oce Technologies B.V., MA Venlo (NL)

( * ) Notice: Subject to any disclaimer, the term of this patent is extended or adjusted under 35 U.S.C. 154(b) by 0 days.

(21) Appl. No.: 09/662,882

(22) Filed: Sep. 15, 2000

(30) Foreign Application Priority Data

Sep. 16, 1999 (NL) ..... 1013063

(51) Int. Cl.[7] ..... B41J 2/15
(52) U.S. Cl. ..... 347/41; 347/19
(58) Field of Search ..... 347/12, 40, 41, 347/43, 15, 16, 19, 14

(56) References Cited

U.S. PATENT DOCUMENTS

| | | | | | |
|---|---|---|---|---|---|
| 5,124,720 | A | | 6/1992 | Schantz | |
| 5,640,183 | A | | 6/1997 | Hackleman | |
| 5,784,078 | A | * | 7/1998 | Furuya | 347/40 |
| 5,844,585 | A | * | 12/1998 | Kurashima et al. | 347/43 |
| 6,190,001 | B1 | * | 2/2001 | Saruta | 347/41 |
| 6,217,149 | B1 | * | 4/2001 | Takagi et al. | 347/41 |

FOREIGN PATENT DOCUMENTS

| | | |
|---|---|---|
| EP | A2-0783973 | 7/1997 |
| EP | A2-0842781 | 5/1998 |
| EP | A1-0914954 | 5/1999 |

* cited by examiner

*Primary Examiner*—John Barlow
*Assistant Examiner*—Lamson D. Nguyen
(74) *Attorney, Agent, or Firm*—Birch, Stewart, Kolasch & Birch, LLP

(57) ABSTRACT

A print head for an inkjet printer with n interlacing passes. The print head is provided with a number of regular nozzles disposed in a row. The row has a first end and a second end, each formed by an associated regular nozzle. Neighboring regular nozzles are spaced apart by a regular nozzle pitch N, where N=n*ds, where ds is the dot pitch. A reserve nozzle is disposed at a distance from at least one of the ends of the row and in extension of the row. The distance between the reserve nozzle and the associated end of the row is I*ds, where I is an integer and is unequal to (p/k)*n where p is an integer, and k is an integer less than n. A method of printing an image built up from a number of sub-images, wherein neighboring sub-images are spaced apart by a dot pitch ds. The method in which the inventive print head is used comprises performing a number of printing passes of the print head to form the number of sub-images. Also, the position of a defective regular nozzle is detected before and during a first printing pass respectively. The print head is displaced over a distance between a preceding and a following printing pass, such that the reserve nozzle during the following printing pass comes into the position occupied by the defective nozzle in the preceding printing pass.

8 Claims, 4 Drawing Sheets

PRINT HEAD FOR AN INKJET PRINTER

BACKGROUND OF THE INVENTION

The present invention relates to a print head for an inkjet printer which utilizes n interlacing passes. The print head is provided with a plurality of regular nozzles disposed in a row, the row having a first end and a second end, each defined by an associated regular nozzle. Neighboring regular nozzles are positioned from one another at a distance of a regular nozzle pitch N, where N=n*ds, ds being the dot pitch (the distance between two drops on a paper). A reserve nozzle is located at a distance from at least one of the ends of the row of nozzles, thus providing an extension of the row of nozzles.

The present invention also relates to a method of printing an image built up from a number of sub-images.

A print head is known from EP-A-0 783 973. In this known print head, the number of interlacing passes required is 1, so that n=1 and the dot pitch ds is equal to the regular nozzle pitch N. The distance between the reserve nozzle and the end is also a multiple of the regular nozzle pitch. In this method, the print head is moved from a starting position over an "outgoing pass" and thus an image is printed by properly operating the regular nozzles. The nozzle which is not operative is recorded. The print head is then displaced over one or more nozzle pitches in a direction perpendicular to the outgoing pass so that a properly operating nozzle comes into the position of a non-printed line caused by a defective nozzle. The non-printed line from the "outgoing" pass is then printed during the movement of the print head in the opposite direction to the outgoing pass, that is, on the "return" pass, with the associated properly operating regular nozzle. The other nozzles are not activated on this return pass. Finally the print head is moved back in a direction perpendicular to the outgoing pass into the original starting position and the print head is moved up over a "swath" length, i.e. over the complete length of the row of regular nozzles, in a direction perpendicular to the outgoing and return pass into a new starting position. The printing of lines which have not been printed due to a defective nozzle, using this known method, has the disadvantage of a loss of productivity. Also, a separate printing pass is required to fill in a non-printed line due to a defective nozzle. Only the missing line is printed in this printing pass. Print heads are also known with an interlacing pass n>1.

SUMMARY OF THE INVENTION

It is the object of the present invention to provide a print head with an interlacing pass n>1 wherein the loss of productivity due to the printing of A missing line due to a defective nozzle is considerably reduced.

To this end, a print head of the type described above is provided, wherein the number of interlacing passes required, n, is larger than 1 (n>1) and the distance 10 between the reserve nozzle and the associated end of the row is I*ds, where I is an integer and is not equal to (p/k)*n, where p is an integer, and k is an integer smaller than n. Since interlacing is effected, an image is built up from different sub-images, the number of sub-images being equal to n. When the distance satisfies this condition, the reserve nozzle is not situated at a distance of a multiple of the regular nozzle pitch from the end. Consequently, on displacement of the reserve nozzle to the position of a missing line, in order to fill in the line in a following pass, the regular nozzles being disposed in a following pass at locations of lines which have already been filled in is avoided.

In a preferred embodiment of a print head according to the present invention, the loss of productivity is further reduced by disposing a reserve nozzle at both ends.

In still another embodiment of the print head of the present invention, the latter is provided with a plurality of reserve nozzles at one end.

In particular, print heads are used for ink jet printers with an interlacing pass of n=4. In these conditions therefore I can be odd, while in order to avoid making the print head too large I is kept low.

The present invention further applies to a method of printing an image built up from a number of sub-images, wherein neighboring sub-images are spaced apart by a dot pitch ds, in which a print head is used in accordance with the invention, said method comprising the steps of:

performing a number of printing passes of the print head to form the number of sub-images, detecting the position of a defective regular nozzle before and during a first printing pass respectively, and displacing the print head over a distance between a preceding and a following printing pass such that the reserve nozzle, during the following printing pass, comes into the position occupied by the defective nozzle in the preceding printing pass. As a result, on a subsequent printing pass, not only the missing line due to the defective nozzle can be filled in by the reserve nozzle, but also a following sub-image is printed by the properly operating regular nozzles. The properly operating regular nozzles are situated on lines which have not yet been printed, as a result of the inventive choice of the distance of the reserve nozzle from the end of the row of regular nozzles.

In a preferred embodiment of the method according to the present invention, a grid of eight sub-images is made with an interlacing pass n=4, and a first reserve nozzle and a second reserve nozzle are used, wherein an extra pass, sub-image number 9, is made during which both reserve nozzles print simultaneously in such manner that no blank line continues to remain in the grid due to a defective nozzle. With this method, a first series of four sub-images is first printed. The print head then shifts over a print head length and a second series of four sub-images is printed. The two blank lines finally remaining in these conditions due to the defective nozzle are printed in the extra pass, i.e., sub-image No. 9. This method is for use on print heads with an arbitrary interlacing pass n, by performing the extra pass after the nth printing pass, only the first and second reserve nozzles printing in this case.

BRIEF DESCRIPTION OF THE DRAWINGS

A number of exemplified embodiments of the invention will NOW be described hereinafter by way of example with reference to the drawings; wherein.

DETAILED DESCRIPTION OF THE INVENTION

Figure 1:
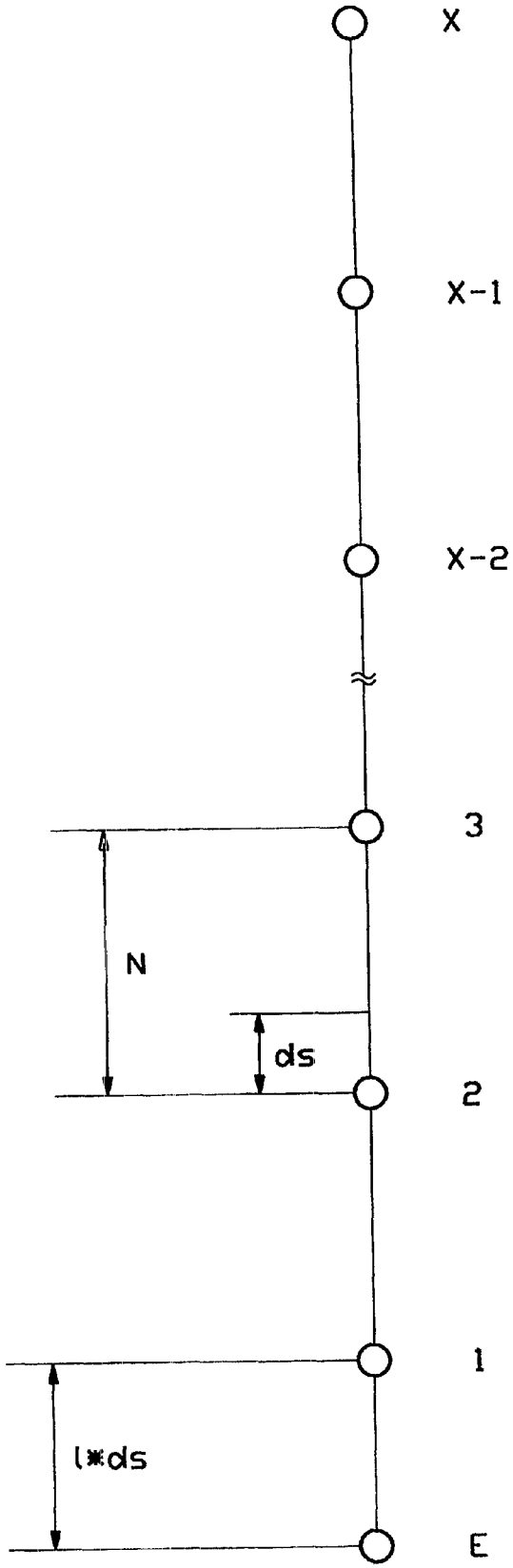
FIG. 1 is a diagram showing a print head with x regular nozzles and a reserve nozzle.

FIG. 1 shows the print head for an inkjet printer according to the invention. The distance between adjacent regular nozzles, i.e., the nozzle pitch, is denoted by N. The distance over which the print head is displaced in the printing of consecutive sub-images, i.e. the dot pitch, is denoted by ds. The number of sub-images from which an image is built up is termed the interlacing pass, and according to the present invention it is an integer greater than 1. The following relationship exists between the nozzle pitch, the dot pitch and the interlacing pass: n=N/ds. A print head comprises x regular nozzles. Printing takes place with these regular nozzles. In practice, the number of x regular nozzles is, for example: 128, 256 or 512. The invention will be explained hereinafter by reference to an example with four interlacing passes. However, it will be clear that the invention can also be applied to any other number of interlacing passes greater than 1. By using interlacing, printing is effected by building up the image from a number of sub-images, the neighboring sub-images being spaced apart by the dot pitch ds. This is done as follows. First of all the first sub-image is printed by the regular nozzles. The print head is then moved up perpendicularly to the printing direction over a dot pitch ds and a second sub-image is printed by the regular nozzles. The print head is then again moved up over a dot pitch ds and the third sub-image is printed. In this example, the printing of sub-images takes place four times in all. The print head is then displaced over a print head length, perpendicularly to the printing direction, and repeats the printing of the four sub-images followed by the moving of the print head up over a print head length. In practice the values for the nozzle pitch N and the dot pitch ds can be extremely small, for example:

$N$=40 $\mu$m, $ds$=10 $\mu$m (interlacing pass $n$=4: $ds$=$N/n$).

By printing in this way, it is possible to obtain a clear image with an acceptable quality. The breakdown of a regular nozzle in a printer as described above using the method as described results in white streaks in the print, so that the print quality declines. This is obviated by the present invention by adding an extra nozzle, i.e., a reserve nozzle E, at the end of the row of regular nozzles, formed by regular nozzle 1, as shown in FIG. 1. The distance from the reserve nozzle E to the end 1 of the row of regular nozzles is I*ds, where I is an integer not equal to (p/k)*n where p is an integer, and k is an integer smaller than n. In the case described here, where n=4, this formula has the result that I is odd. As a result of this inventive choice of the distance from a reserve nozzle E to the end 1 of the row of regular nozzles, an efficiency increase is achieved in printing as will be explained hereinafter. Let it be assumed, for example, that nozzle 3 shown in FIG. 1 is defective, something which is detectable in manner known per se which will not be described in detail here. The first sub-image is printed by the properly working regular nozzles. The reserve nozzle E does not print during this first sub-image. In this first sub-image there is therefore now a white line present at the location of nozzle 3. The print head is then not moved up over one dot pitch, but over a distance such that the reserve nozzle E comes into the position of the white line. The second sub-image is then printed, in which case both the properly operating regular nozzles and the reserve nozzle E print. At the location of the white line due to the defective nozzle 3 of the first sub-image, printing is now effected by the reserve nozzle E while the regular nozzles print lines on positions which have not yet been printed. A second sub-image is printed in this way. A white line will also form in this second sub-image as a result of the defective nozzle 3.

This line can again be printed by moving the print head up over a distance such that the reserve nozzle E comes to rest in the position of the white line in the second sub-image due to the defective nozzle 3.

Thus, four sub-images are printed, and a white line will remain as a result of the defective nozzle 3 only in the last sub-image. The fact that when a missing line due to a defective nozzle 3 is printed and the regular nozzles do not come into position on lines already printed, is the result of the inventive choice of the distance between the reserve nozzle E and the end 1 of the row of regular nozzles.

The inventive method should be used independently of the location of the defective regular nozzle. If the defective nozzle is far away from the reserve nozzle, then in the first instance an image will form which is not particularly sharp because the print head is displaced over a relatively large distance between two sub-images. If, for example, a regular nozzle breaks down at the other end from where the reserve nozzle is situated, then the print head will still be displaced over substantially one print head distance during the printing of consecutive sub-images. This results in an image which is not particularly sharp. This phenomenon, however, can be eliminated by programming the print head so that the missing lines due to the movement of the print head are filled in prior to or following on the printing of the sub-images. In this way and with this print head a print of acceptable quality is obtained in an efficient manner.

In practice, in the example of FIG. 1, (n=4), 3*ds can be selected, for example, for the distance from the reserve nozzle to the end of the row of regular nozzles. According to the equation for determining this distance, 1*ds would also be admissible, but this distance can be obtained only with considerable difficulty in view of the small distance of 10 $\mu$m in this exemplified embodiment. A distance of 3*ds (30 m$\mu$) is easier to embody in practice.

Figure 2:
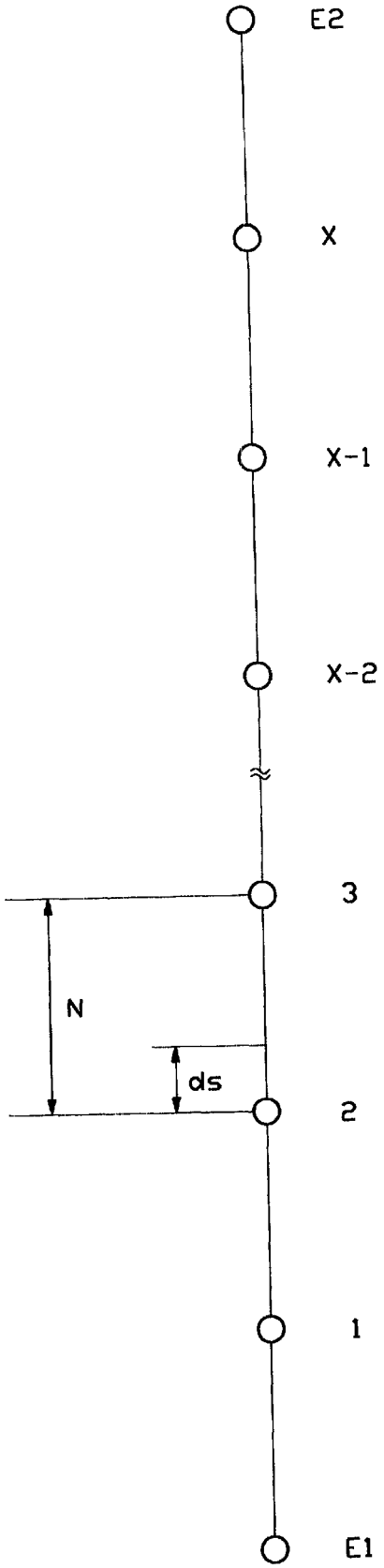
FIG. 2 is a diagram showing a print head with x regular nozzles and a reserve nozzle at both ends.

FIG. 2 shows a print head according to the present invention with a reserve nozzle E1, E2 at both ends of the row of regular nozzles, respectively formed by regular nozzle 1 and x. By the use of reserve nozzles E1, E2 at both ends 1, x, an added efficiency increase is obtained compared with the use of just one reserve nozzle, when a regular nozzle breaks down. This will be explained by reference to the description of FIG. 3.

Figure 3:
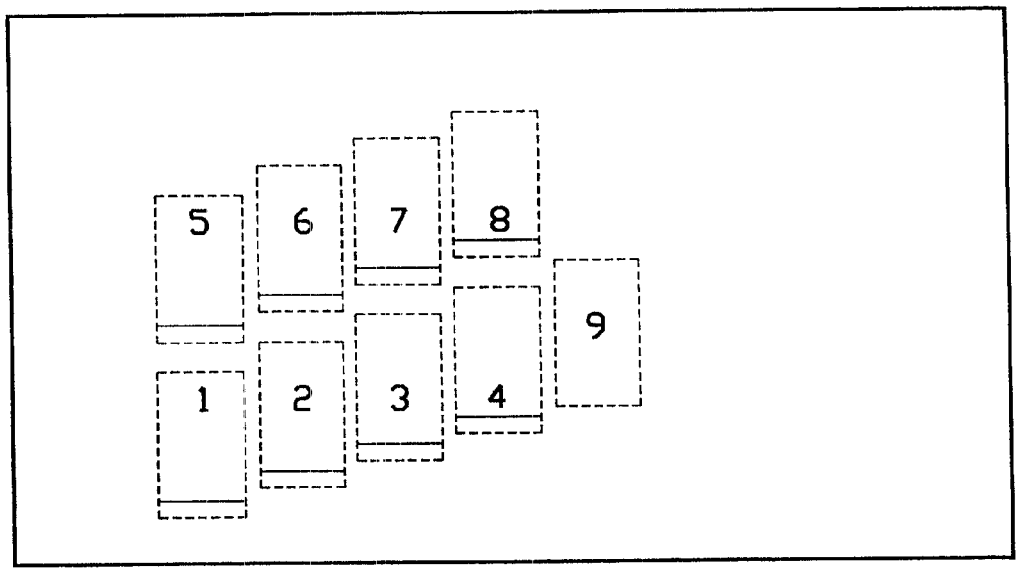
FIG. 3 is a diagram showing a method in which a grid of eight sub-images is made with an interlacing pass n=4, with two reserve nozzles being used.

FIG. 3 is a diagram showing a method in which a grid of eight sub-images is made with a number of interlacing passes n=4, using a first reserve nozzle E1 and a second reserve nozzle E2 as shown in FIG. 2. The distance between the reserve nozzles E1, E2 is so selected that the two missing lines left after printing the eight sub-images and resulting from a defective nozzle can be filled in, in one extra pass, as will be explained hereinafter.

The first sub-image is printed with properly operating regular nozzles (pass 1). In FIG. 3, the white line due to the defective nozzle is shown as a solid black line in the first sub-image. The print head is then moved up over a distance such that the first reserve nozzle E1 fills in the missing line due to the defective nozzle; in this case the properly operating regular nozzles simultaneously print the second sub-image (pass 2). In FIG. 3, the white line forming as a result of the defective nozzle in this second sub-image is again shown as a solid black line. It will also be seen that the first reserve nozzle E1 has now printed at the location of the white line due to the defective nozzle, which formed during the printing of the first sub-image; the solid black line in FIG. 3 forming in the first sub-image has now disappeared. Then another two sub-images are printed in which the print head is always so moved up that the first reserve nozzle E1 prints the missing line of the previous printing pass (passes 3 and 4), as shown in FIG. 3. The properly operating regular nozzles also print new sub-images during passes 3 and 4.

In the case of the sub-image belonging to pass 4, a blank line is now present due to the defective nozzle.

The print head is then moved up over a print head length and again four sub-images are printed (passes 5 to 8 inclusive) in accordance with the above-described method. Here again the eighth sub-image belonging to pass 8 will still have a white line.

By now performing an extra pass 9, in which both the first reserve nozzle E1 and the second reserve nozzle E2 print, and the properly operating regular nozzles do not print, both lines still missing, one in the fourth sub-image and the other in the eighth sub-image, are printed in one pass. In practice, pass 9 could also be performed after pass 4 and before pass 5. In this way a complete image of acceptable quality is obtained without missing lines and with a time loss of only 12.5%.

Figure 4:
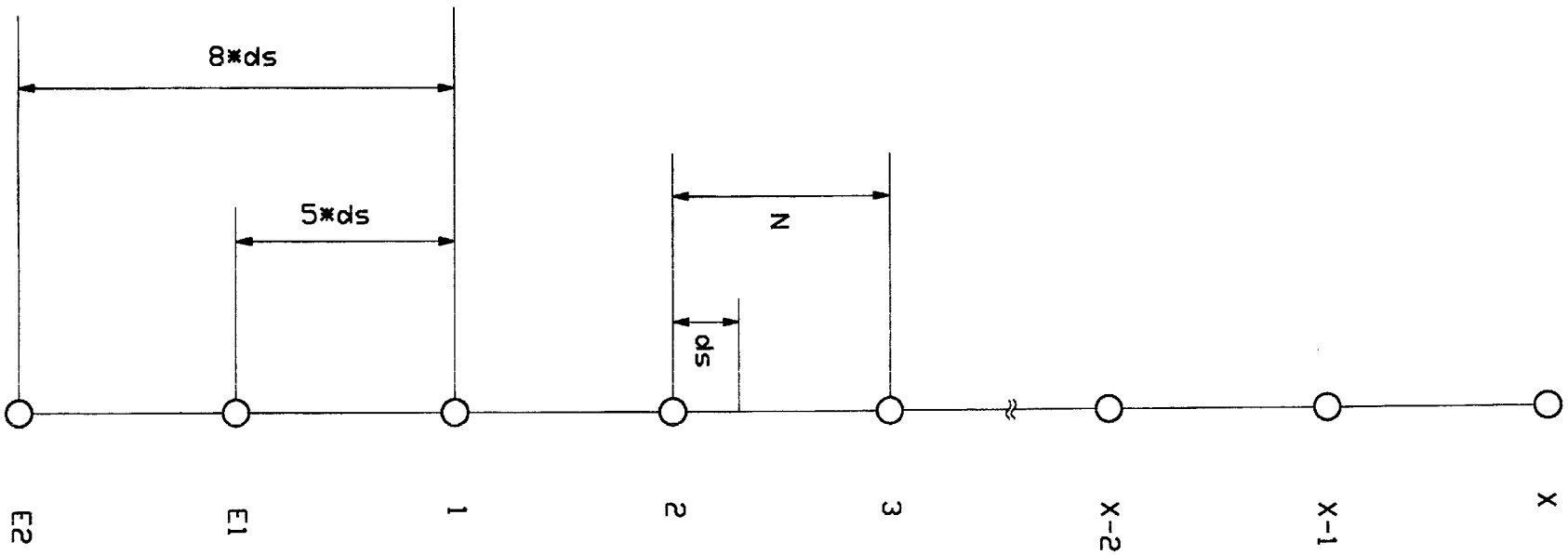
FIG. 4 is a diagram showing a print head with x regular nozzles with a plurality of reserve nozzles at one end.

FIG. 4 shows an alternative embodiment of a print head according to the present invention with a number of reserve nozzles at one end. As a result of this construction pass 9 can then be filled in, for example, by reserve nozzle E2 and regular nozzle x−1.

The invention is effective irrespective of the number of nozzles of the print head and the location of the defective nozzle. The distance from the reserve nozzle to the associated end should satisfy the inventive relationship, and it will be clear that in order to keep the print head compact the distance is preferably made as small as possible in practice. It should also be noted that the invention is not limited to a print head with one row of regular nozzles, but can also be applied to a print head having a plurality of rows of regular nozzles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A print head for an inkjet printer with n interlacing passes, said print head comprising a plurality of regular nozzles disposed adjacent to each other in a row, the row having a first end and a second end, each formed by one of said regular nozzles, said adjacent regular nozzles being positioned from each other at a distance of a regular nozzle pitch N, where N=n*ds, ds being the dot pitch, and a reserve nozzle being located at a distance from at least one of the ends of the row of nozzles and in extension of said row, wherein the interlacing pass is n>1, and the distance between the reserve nozzle and the associated end of the row is I*ds, where 1 is an integer and is not equal to (p/k)*n, where p is an integer, and k is an integer smaller than n.

2. The print head according to claim 1, wherein a reserve nozzle is placed at both ends.

3. The print head according to claim 1, wherein a plurality of reserve nozzles are disposed at one end.

4. The print head according to claim 1, wherein n=4, with I being odd.

5. A method of printing an image built up from a number of sub-images, wherein adjacent sub-images are spaced apart by a dot pitch ds, in which method a print head is used having a plurality of regular nozzles disposed adjacent to each other in a row, said adjacent regular nozzles being positioned from each other at a distance of a regular nozzle pitch N, where N=n*ds, where n represents the interlacing passes in which n>1, and a reserve nozzle is located at a distance from at least one of the ends of the row of nozzles, said method comprising the steps of:

performing a number of printing passes of the print head to form the number of sub-images, detecting the position of a defective regular nozzle before and during a first printing pass, respectively, and displacing the print head over a distance between a preceding and a following printing pass, such that the reserve nozzle, during the following printing pass, comes to the position occupied by the defective nozzle in the preceding printing pass.

6. The method according to claim 5, wherein a grid of eight sub-images is made, wherein a first reserve nozzle and a second reserve nozzle are used and wherein an extra pass, sub-image number 9, is made during which both reserve nozzles print simultaneously in such a manner that no blank line continues to remain in the grid due to a defective nozzle.

7. The method of claim 6, wherein the distance of the reserve nozzle from the end of the row of regular nozzles is I*ds, where I is an integer not equal to (p/k)*n where p is an integer and k is an integer smaller than n.

8. The method of claim 7, wherein n=4.

* * * * *